US007131644B2

(12) United States Patent
Williamson et al.

(10) Patent No.: US 7,131,644 B2
(45) Date of Patent: Nov. 7, 2006

(54) IMAGING APPARATUS HAVING AN AUTOMATIC SHEET FEEDER

(75) Inventors: Randal Scott Williamson, Lexington, KY (US); Edmund Hulin James, III, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 28 days.

(21) Appl. No.: 10/818,596

(22) Filed: Apr. 6, 2004

(65) Prior Publication Data

US 2005/0225024 A1 Oct. 13, 2005

(51) Int. Cl.
*B65H 3/52* (2006.01)
*B65H 1/26* (2006.01)

(52) U.S. Cl. ..... 271/121; 271/157

(58) Field of Classification Search ..... 271/127, 271/157, 124, 117, 118, 162, 121, 167, 110
See application file for complete search history.

(56) References Cited

U.S. PATENT DOCUMENTS 4,032,137 A 6/1977 Katayama et al.
4,406,448 A 9/1983 Kulpa et al.
4,456,240 A 6/1984 Chu et al.
4,763,891 A 8/1988 Kodama
4,772,007 A 9/1988 Kashimura
4,865,306 A * 9/1989 Himegi ..... 271/121
5,464,205 A 11/1995 Bang
5,775,687 A 7/1998 Nakatani et al.
5,813,780 A * 9/1998 Kiyohara et al. ..... 400/629
5,883,798 A * 3/1999 Yamaguchi ..... 363/73
5,944,306 A 8/1999 Maeda et al.
5,971,390 A * 10/1999 Caspar et al. ..... 271/121
6,178,017 B1 1/2001 Ishida
6,227,535 B1 * 5/2001 Bae ..... 271/121
6,308,947 B1 * 10/2001 Kojima et al. ..... 271/124
6,352,256 B1 * 3/2002 Hsieh ..... 271/110
6,469,811 B1 10/2002 Tamura
6,536,757 B1 * 3/2003 Chang ..... 271/16
6,626,595 B1 * 9/2003 Kabamoto ..... 400/624
6,716,254 B1 * 4/2004 Takeuchi ..... 271/167
6,883,798 B1 * 4/2005 Hsieh ..... 271/124
6,896,253 B1 * 5/2005 Hanabusa ..... 271/117
6,908,081 B1 * 6/2005 Takito et al. ..... 271/121
2002/0163117 A1 * 11/2002 Hsieh ..... 271/121
2003/0063337 A1 4/2003 Shirai et al.

* cited by examiner

*Primary Examiner*—Kathy Matecki
*Assistant Examiner*—Rakesh Kumar
(74) *Attorney, Agent, or Firm*—Taylor & Aust, PC

(57) ABSTRACT

An imaging apparatus includes a sheet separation surface positioned along the sheet feed path downstream from a media tray. A plurality of pivoting arms is mounted in the imaging apparatus. The pivoting arms are moveable between a first position and a second position. The pivoting arms are positioned and individually spaced along a width of the sheet feed path. Each of the pivoting arms has a media stack engaging surface. When the pivoting arms are in the first position, the media stack engaging surface is non-parallel to the sheet separation surface. When the plurality of pivoting arms is in the second position, the media stack engaging surface is parallel to the sheet separation surface.

6 Claims, 5 Drawing Sheets

IMAGING APPARATUS HAVING AN AUTOMATIC SHEET FEEDER

BACKGROUND OF THE INVENTION

1. Field of the Invention

The present invention relates to an imaging apparatus, and, more particularly, to an imaging apparatus having an automatic sheet feeder.

2. Description of the Related Art

An imaging apparatus typically includes an automatic sheet feeder (ASF) including a media tray and a sheet picking mechanism. The automatic sheet feeder automatically supplies a sheet of print media from a stack of print media positioned in the media tray to the print engine. During the loading of the media tray of the automatic sheet feeder, however, some of the print media may be pushed down into the automatic sheet feeder too far, resulting in simultaneous multiple sheet feeds, and may ultimately result in a media jam.

In addition, imaging apparatus failure may occur due to a foreign object being dropped into the automatic sheet feeder. This may occur, for example, in a typical imaging apparatus due to the open nature of the media tray, or due to the open nature of an imaging apparatus having an L-shaped media path.

What is needed in the art is an imaging apparatus that reduces the occurrence of multiple media picks due to faulty loading of the automatic sheet feeder, and which also may provide a cover to prevent foreign objects from being dropped into the automatic sheet feeder.

SUMMARY OF THE INVENTION

The present invention provides an imaging apparatus that reduces the occurrence of multiple media picks due to faulty loading of the automatic sheet feeder, and also may provide a cover to prevent foreign objects from being dropped into the automatic sheet feeder.

The present invention, in one form thereof, relates to an imaging apparatus having a sheet feed path. The imaging apparatus includes an automatic sheet feeder having a media tray with a sheet support surface for supporting a stack of print media, and a sheet picking mechanism for retrieving individual sheets from the stack of print media. A sheet separation surface is positioned along the sheet feed path downstream from the media tray. A plurality of pivoting arms is mounted in the imaging apparatus. The pivoting arms are moveable between a first position and a second position. The pivoting arms are positioned and individually spaced along a width of the sheet feed path. Each of the pivoting arms has a media stack engaging surface. When the pivoting arms are in the first position, the media stack engaging surface is non-parallel to the sheet separation surface. When the plurality of pivoting arms is in the second position, the media stack engaging surface is parallel to the sheet separation surface.

In another form thereof, the present invention relates to a method for providing a sheet feed apparatus. The method includes the steps of providing a sheet support surface for supporting a stack of print media; providing a sheet picking mechanism for retrieving individual sheets from the stack of print media; positioning a sheet separation surface positioned along a sheet feed path downstream from the media tray; mounting a plurality of pivoting arms in the imaging apparatus, the plurality of pivoting arms being moveable between a first position and a second position, the plurality of pivoting arms being positioned and individually spaced along a width of the sheet feed path, each of the pivoting arms having a media stack engaging surface, wherein when the plurality of pivoting arms is in the first position, the media stack engaging surface is substantially perpendicular to the sheet support surface of the media tray, and when the plurality of pivoting arms is in the second position, the media stack engaging surface is parallel to the sheet separation surface; and selectively moving the plurality of pivoting arms to the first position and to the second position.

An advantage of the present invention is the inclusion of pivoting arms, displaced from the sheet separator surface, which provides a positive stop that performs preliminary straightening of the stack of print media as it is loaded into the media tray, and which facilitate secondary straightening of the stack of print media as the stack is lowered into contact with the sheet separator surface.

Another advantage of the present invention is that it reduces the likelihood of the simultaneous picking of multiple of sheets of media caused from pushing media too far into the media tray.

Still another advantage is that, in some embodiments, a cover is provided to prevent foreign objects from entering the automatic sheet feeder.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
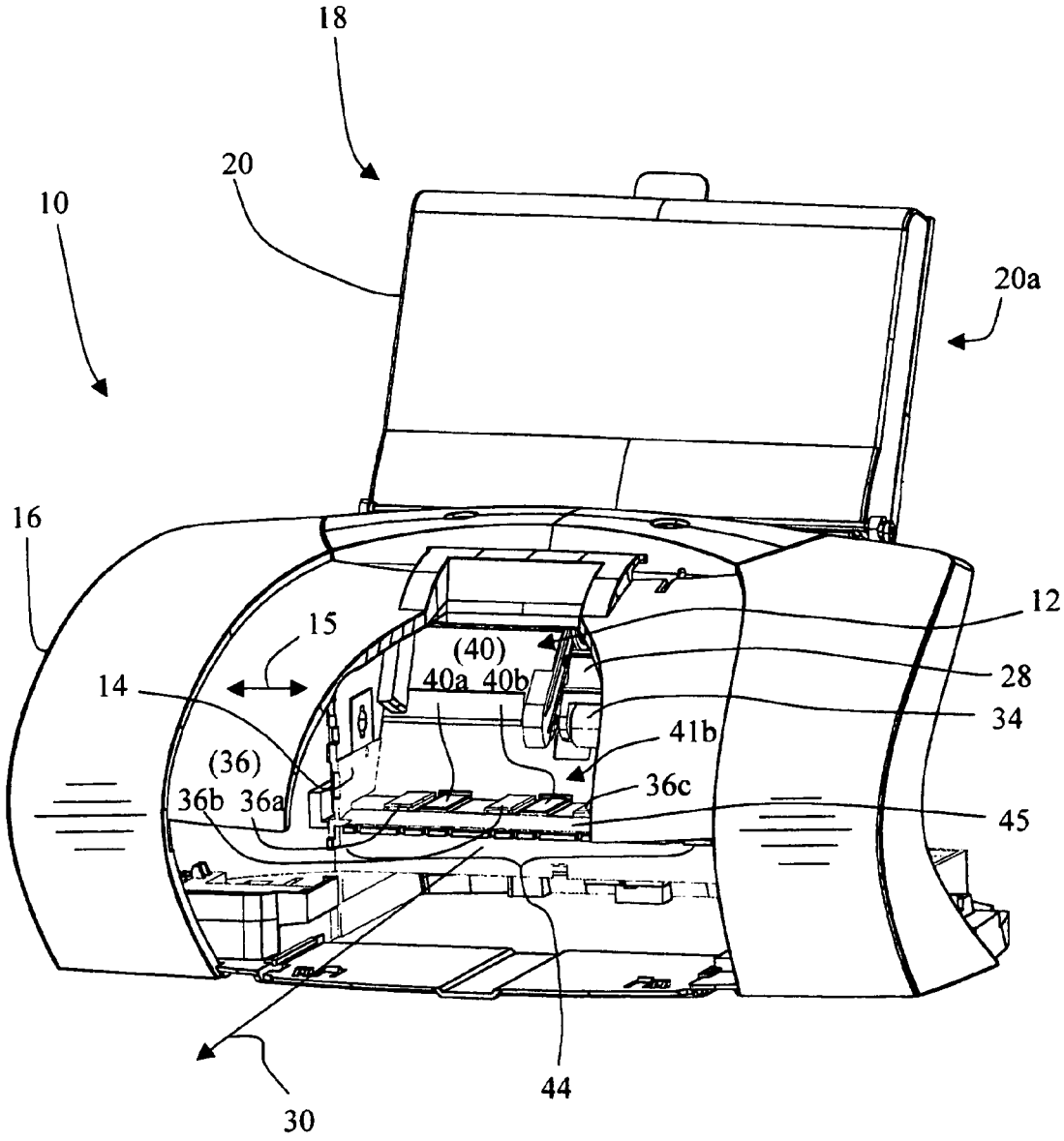
FIG. 1 is a perspective front view of an imaging apparatus in accordance with the present invention, with a portion of the housing cut away to show the pivoting arms in the lowered position.

Referring now to the drawings and particularly to FIGS. 1–4, there is shown an imaging apparatus 10 embodying the present invention.

Imaging apparatus 10 may be, for example, a printer or a multifunction unit. Such a multifunction unit may be configured to perform standalone functions, such as copying or facsimile receipt and transmission, in addition to printing. As shown, imaging apparatus 10 may include, for example, an ink jet print engine 12, which includes, for example, a reciprocating printhead carrier 14 which is transported along a bi-directional scan path 15.

Figure 2:
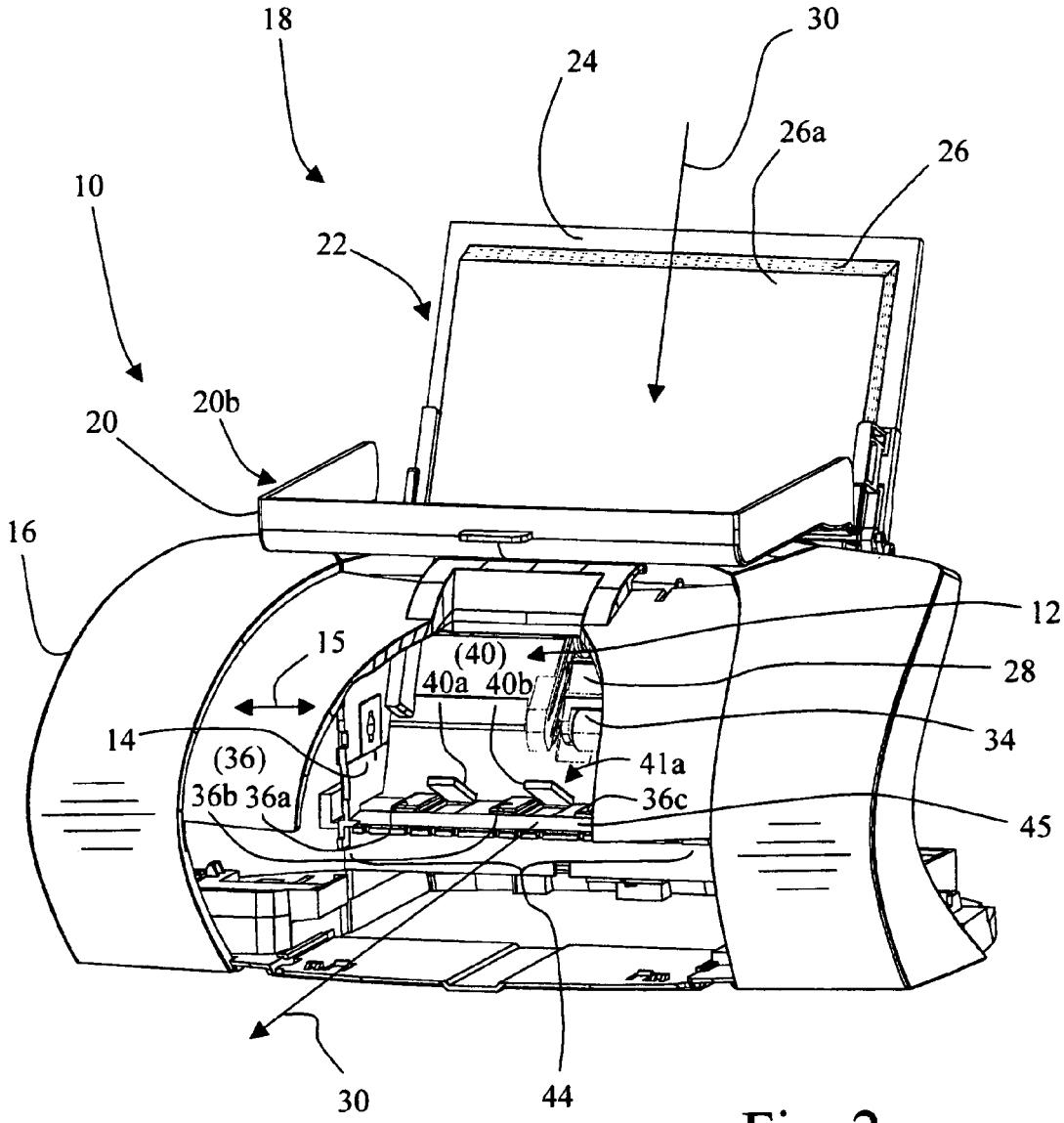
FIG. 2 is a perspective front view of the imaging apparatus of FIG. 1, showing the pivoting arms in the raised position.

Imaging apparatus 10 further includes a housing 16, and an automatic sheet feeder 18 having a cover 20, a media tray 22 with a sheet support surface 24 for supporting a stack of print media 26, and a sheet picking mechanism 28. Cover 20 is pivotably attached to housing 16 of imaging apparatus 10, and is moveable from a closed position 20*a*, as shown in FIG. 1, to an open position 20*b*, as shown in FIG. 2. When in closed position 20*a*, cover 20 serves as an edge guide for the stack of print media 26.

Figure 3:
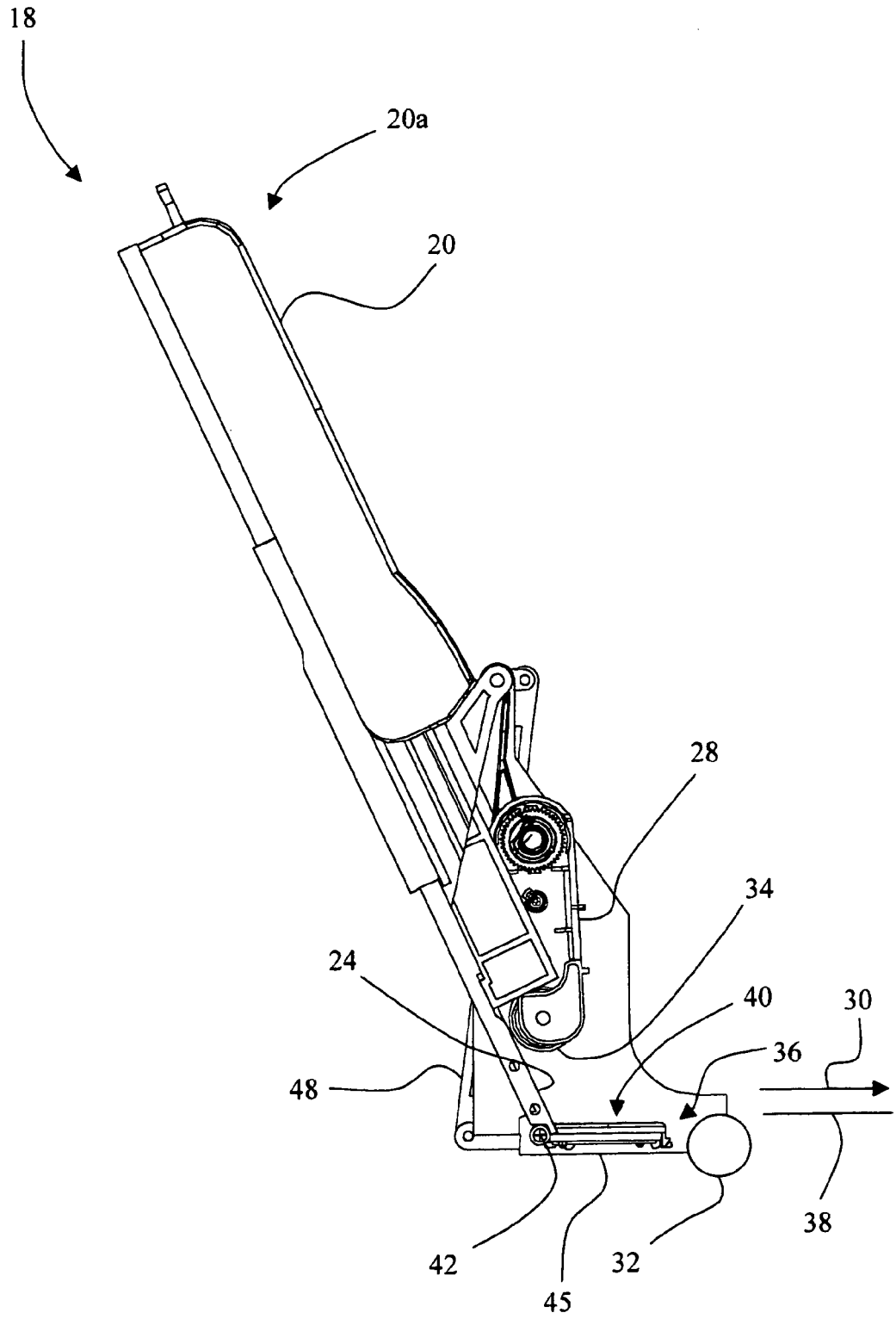
FIG. 3 is a side view of the imaging apparatus arrangement of FIG. 1, with the housing removed to show the pivoting arms in the lowered position.
Figure 4:
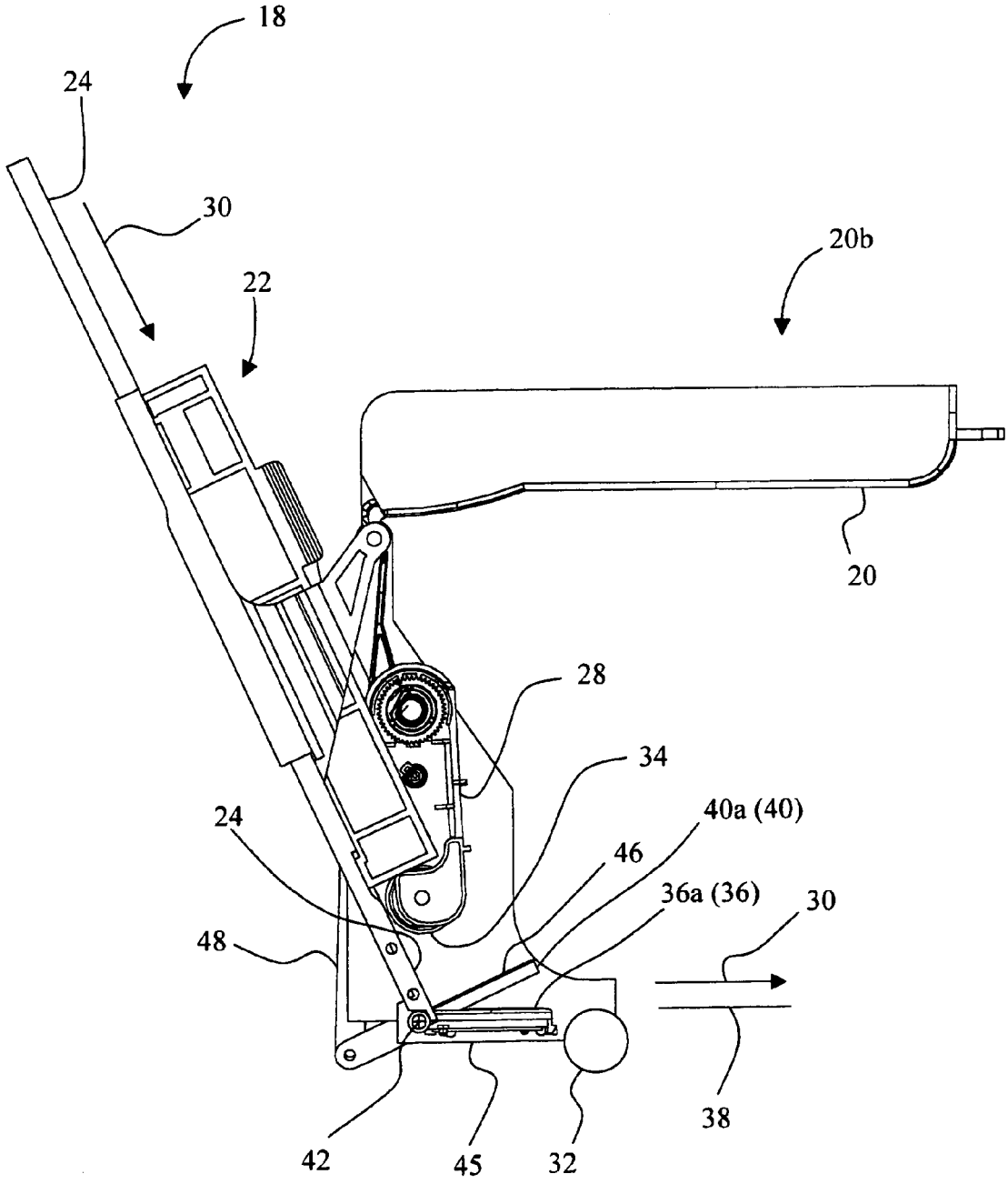
FIG. 4 is a side view of the imaging apparatus arrangement of FIG. 2, with the housing removed to show the pivoting arms in the raised position.

Sheet picking mechanism 28 retrieves, i.e., picks, individual sheets from the stack of print media 26, and transports a sheet 26*a* along a sheet feed path 30 to a feed roller 32, shown in FIGS. 3 and 4. Sheet feed path 30 is substantially perpendicular to bi-directional scan path 15. More particularly, sheet pick mechanism 28 includes a sheet pick roller 34 configured to pick a sheet from the stack of print media 26 held in media tray 22. In the present embodiment, the sheet feed path has an L-shape; however, the principles of the present invention may be applied to other sheet feed path configurations, such as for example, a C-shaped media path.

As shown in FIGS. 1 and 2, a sheet separation surface 36, including individual sheet separation pads 36*a*, 36*b*, 36*c*, is positioned along sheet feed path 30 downstream from media tray 22 in the sheet feed direction indicated by the arrow on the line identifying sheet feed path 30. Sheet separation surface 36 is in a fixed position with respect to sheet feed path 30, i.e., sheet separation surface 36 is not moveable within, and with respect to, imaging apparatus 10. Sheet support surface 24 of media tray 22 is oriented to be inclined with respect to a substantially horizontal plane 38 (see FIGS. 3 and 4), i.e., with respect to sheet separation surface 36.

In the present embodiment, sheet separation surface 36, including individual sheet separating pads 36*a*, 36*b* and 36*c*, is formed by a plurality of elongated bars having high friction characteristics, each of which extends along substantially horizontal plane 38, and which collectively extend along bi-directional scan path 15. Accordingly, the friction generated between separation surface 36 and the stack of print media 26 when a top sheet 26*a* of the stack of print media 26 is engaged by sheet pick roller 34 tends to cause a single sheet of the stack of print media 26 to be picked.

As shown in FIGS. 1–4, a plurality of pivoting arms 40, individually referenced as 40*a* and 40*b*, is mounted in imaging apparatus 10 along a common pivot axis 42 located between sheet support surface 24 and sheet separation surface 36 along sheet feed path 30. As can be best seen in FIGS. 1 and 2, pivot arm 40*a* is positioned between sheet separation pads 36*a* and 36*b*, and pivot arm 40*b* is positioned between sheet separation pads 36*b* and 36*c*. While only two pivot arms 40 and three sheet separation pads of sheet separation surface 36 are shown in this example, it is to be understood that this arrangement may be extended along the entirety of bi-directional scan path 15, if desired.

Pivoting arms 40 are moveable, i.e., pivot, with respect to pivot axis 42, between a first position 41*a* (see FIGS. 2 and 4) and a second position 41*b* (see FIGS. 1 and 3). As shown, the first position 41a is a raised (extended) position, and the second position 41*b* is a lowered (retracted) position. Thus, pivoting arms 40 are movable within, and with respect to, imaging apparatus 10, and more particularly, are movable with respect to sheet feed path 30, while sheet separation surface 36 remains stationary with respect to sheet feed path 30.

The pivoting arms 40 are positioned and individually spaced along a width 44 of sheet feed path 30, and more particularly, along width 44 of mid-frame 45. Width 44 extends along bi-directional scan path 15. Each of the pivoting arms 40 has a media stack engaging surface 46. Media stack engaging surface 46 may, for example, have a textured surface, e.g., a surface having raised bumps, for engaging a downstream end of the stack of print media 26 when pivoting arms 40 are in the first position 41*a*, so as to prevent the stack of print media 26 from slipping off of, or along, pivoting arms 40. When the pivoting arms 40 are in the first position 41*a*, the media stack engaging surface 46 of pivoting arms 40 is non-parallel to sheet separation surface 36, and more particularly, is substantially perpendicular to sheet support surface 24 of media tray 22 (see FIGS. 2 and 4). By the term "non-parallel", it is meant a significant deviation from actual parallel.

Thus, when the pivoting arms 40 are in the first position 41*a*, the pivoting arms 40 provide a positive stop for engaging a downstream end of the stack of print media 26 during the loading of the stack of print media 26 into the media tray 22 of automatic sheet feeder 18. Further, when pivoting arms 40 are in first position 41*a*, pivoting arms 40 provide a positive stop for preventing a sheet from being delivered to feed roller 32. However, when pivoting arms 40 are in the second position 41*b*, the media stack engaging surface 46 is parallel to and slightly lower than sheet separation surface 36 (see FIGS. 1 and 3), and sheet 26*a* picked by sheet picking roller 34 can be delivered to feed roller 32, which in turn further transports sheet 26*a* along sheet feed path 30 and past the reciprocating printhead carrier 14. The term "parallel" is intended to include small deviations from actual parallel.

Accordingly, when the pivoting arms 40 are in the first position 41*a*, the configuration of the present invention advantageously effects preliminary straightening of the stack of print media 26 when the stack of print media 26 is loaded into media tray 22, and then, when the pivoting arms 40 are pivoted to the second position 41*b*, the configuration of the present invention advantageously effects secondary straightening of the stack of print media 26 when the stack of print media 26 is lowered to engage sheet separation surface 36, thereby further straightening the stack of print media 26 with respect to sheet feed path 30.

An operator, in the form of pivotable cover 20, is coupled via a linkage 48 to pivoting arms 40, for selectively moving pivoting arms 40 between the raised (extended) position of first position 41*a* and the lowered (retracted) position of second position 41*b*. Linkage 48 may be connected to each of cover 20 and pivoting arms 40 using, for example, pins or other types of fasteners that permit pivoting motion.

Figure 5:
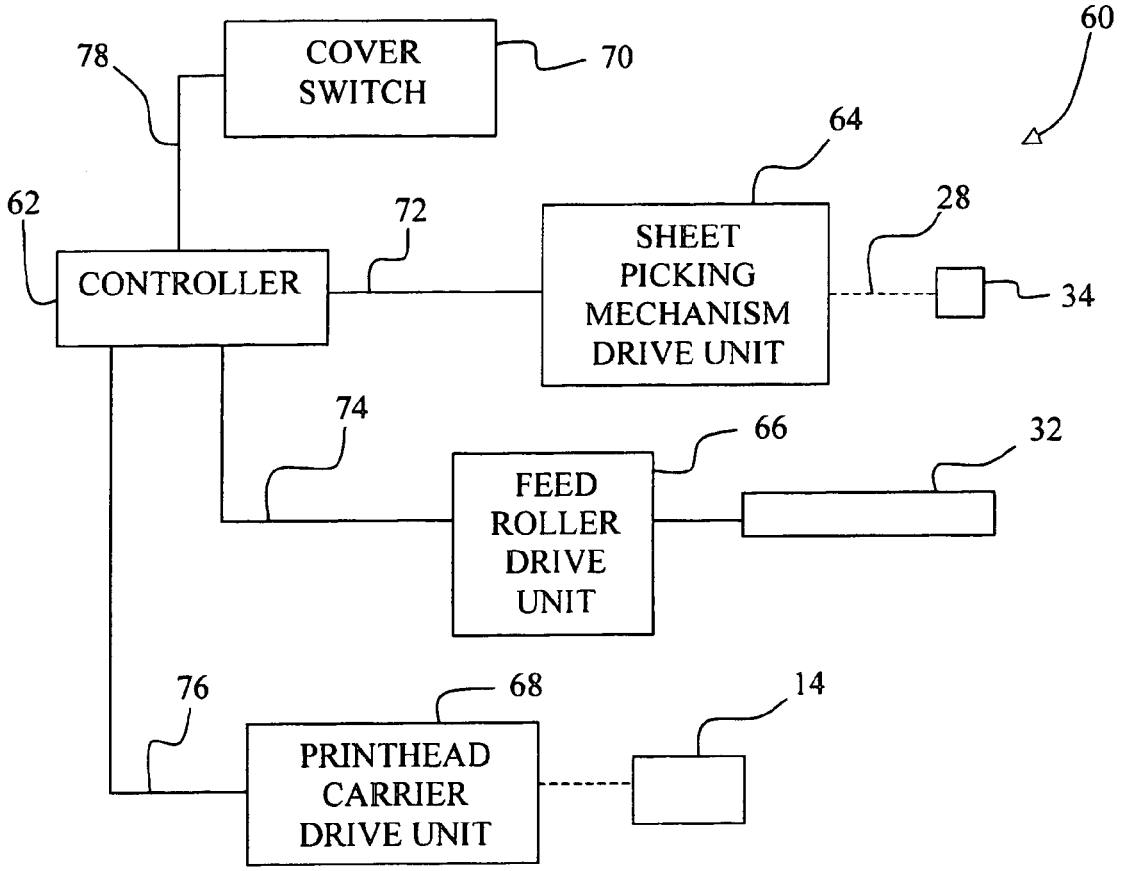
FIG. 5 is a block diagram of control circuitry for the imaging apparatus of FIG. 1.

Referring to FIG. 5, there is shown a simplified block diagram of control circuitry 60 associated with imaging apparatus 10. Control circuitry 60 includes a controller 62, a sheet picking mechanism drive unit 64, a feed roller drive unit 66, a printhead carrier drive unit 68, and a cover switch 70. Controller 62 is communicatively coupled to sheet picking mechanism drive unit 64 via a communications link 72. Controller 62 is communicatively coupled to feed roller drive unit 66 via a communications link 74. Controller 62 is communicatively coupled to printhead carrier drive unit 68 via a communications link 76. Controller 62 is communicatively coupled to cover switch 70 via a communications link 78. Communications links 72, 74, 76 and 78 may be a wired connection, or may be a wireless link.

Controller 62 may be formed as an application specific integrated circuit (ASIC), and includes processing capability, which may be in the form of a microprocessor having an associated random access memory (RAM) and read only memory (ROM). Controller 62 executes program instructions to effect the printing of an image on a sheet of the stack of print media 26.

During operation, referring also to FIGS. 1–4, controller 62 supplies a command to sheet picking mechanism drive unit 64 to pick a sheet 26*a* from the stack of print media 26. In turn, sheet picking mechanism drive unit 64 activates sheet picking mechanism 28, which responds by rotating sheet pick roller 34. Controller 62 further commands feed roller drive unit 66 to rotate feed roller 32 by a predetermined index feed distance to convey sheet 26*a* along the sheet feed path 30. During printing, controller 62 provides commands to printhead carrier drive unit 68, which in turn effects a reciprocation of printhead carrier 14 across the width of sheet 26*a*.

Cover switch 70 senses whether cover 20 is in the closed position 20*a*, or has been moved from the closed position 20*a* toward the opened position 20*b*. When cover switch 70 senses that cover 20 has been moved from the closed position 20*a* toward the opened position 20*b*, cover switch 70 supplies a signal to controller 62, which in turn deactivates sheet picking mechanism drive unit 64, thereby preventing rotation of sheet pick roller 34 until cover switch 70 senses that cover 20 has been returned to the closed position 20*a*.

While this invention has been described with respect to a particular embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus having a sheet feed path, comprising:

an automatic sheet feeder having a media tray with a sheet support surface for supporting a stack of print media, and a sheet picking mechanism for retrieving individual sheets from said stack of print media;

a sheet separation surface positioned along said sheet feed path downstream from said media tray; and a plurality of pivoting arms mounted in said imaging apparatus, said plurality of pivoting arms being moveable between a first position and a second position, said plurality of pivoting arms being positioned and individually spaced along a width of said sheet feed path, each of said pivoting arms having a media stack engaging surface, wherein when said plurality of pivoting arms is in said first position, said media stack engaging surface is non-parallel to said sheet separation surface, and when said plurality of pivoting arms is in said second position, said media stack engaging surface is parallel to said sheet separation surface, said sheet separation surface being formed by a plurality of sheet separation pads spaced apart along a bi-directional scanning path of said imaging apparatus, wherein said plurality of pivoting arms are interspersed with said plurality of sheet separation pads.

2. An imaging apparatus having a sheet feed path, comprising:

an automatic sheet feeder having a media tray with a sheet support surface for supporting a stack of print media, and a sheet picking mechanism for retrieving individual sheets from said stack of print media;

a sheet separation surface positioned along said sheet feed path downstream from said media tray; and a plurality of pivoting arms mounted in said imaging apparatus, said plurality of pivoting arms being moveable between a first position and a second position, said plurality of pivoting arms being positioned and individually spaced along a width of said sheet feed path, each of said pivoting arms having a media stack engaging surface, wherein when said plurality of pivoting arms is in said first position, said media stack engaging surface is non-parallel to said sheet separation surface, and when said plurality of pivoting arms is in said second position, said media stack engaging surface is parallel to said sheet separation surface, said sheet separation surface being formed by a plurality of sheet separation pads spaced apart along a bi-directional scanning path of said imaging apparatus, wherein said plurality of pivoting arms and said plurality of sheet separation pads are alternatingly disposed along said bi-directional scanning path.

3. An imaging apparatus having a sheet feed path, comprising:

an automatic sheet feeder having a media tray with a sheet support surface for supporting a stack of print media, and a sheet picking mechanism for retrieving individual sheets from said stack of print media;

a sheet separation surface positioned along said sheet feed path downstream from said media tray; and a plurality of pivoting arms mounted in said imaging apparatus, said plurality of pivoting arms being moveable between a first position and a second position, said plurality of pivoting arms being positioned and individually spaced along a width of said sheet feed path, each of said pivoting arms having a media stack engaging surface, wherein when said plurality of pivoting arms is in said first position, said media stack engaging surface is non-parallel to said sheet separation surface, and when said plurality of pivoting arms is in said second position, said media stack engaging surface is parallel to said sheet separation surface, wherein when said plurality of pivoting arms is in said second position, said media stack engaging surface is lower than said sheet separation surface.

4. An imaging apparatus having a sheet feed path, comprising:

an automatic sheet feeder having a media tray with a sheet support surface for supporting a stack of print media, and a sheet picking mechanism for retrieving individual sheets from said stack of print media;

a sheet separation surface positioned along said sheet feed path downstream from said media tray;

a plurality of pivoting arms mounted in said imaging apparatus, said plurality of pivoting arms being moveable between a first position and a second position, said plurality of pivoting arms being positioned and individually spaced along a width of said sheet feed path, each of said pivoting arms having a media stack engaging surface, wherein when said plurality of pivoting arms is in said first position, said media stack engaging surface is non-parallel to said sheet separation surface, and when said plurality of pivoting arms is in said second position, said media stack engaging surface is parallel to said sheet separation surface;

an operator coupled to said plurality of pivoting arms for moving said plurality of pivoting arms between said first position and said second position, wherein said operator is a cover attached to a housing of said imaging apparatus, said cover being moveable from a closed position to an open position; and said sheet picking mechanism including a sheet pick roller configured to pick a sheet from said stack of print media in said media tray, said imaging apparatus further comprising a switch configured to prevent rotation of said sheet pick roller when said cover is not closed.

5. An imaging apparatus having a sheet feed path, comprising:

an automatic sheet feeder having a media tray with a sheet support surface for supporting a stack of print media, and a sheet picking mechanism for retrieving individual sheets from said stack of print media;

a sheet separation surface positioned along said sheet feed path downstream from said media tray;

a plurality of pivoting arms mounted in said imaging apparatus, said plurality of pivoting arms being moveable between a first position and a second position, said plurality of pivoting arms being positioned and individually spaced along a width of said sheet feed path, each of said pivoting arms having a media stack engaging surface, wherein when said plurality of pivoting arms is in said first position, said media stack engaging surface is non-parallel to said sheet separation surface, and when said plurality of pivoting arms is in said second position, said media stack engaging surface is parallel to said sheet separation surface;

an operator coupled to said plurality of pivoting arms for moving said plurality of pivoting arms between said first position and said second position, wherein said operator is a cover attached to a housing of said imaging apparatus, said cover being moveable from a closed position to an open position; and said cover forming an edge guide for said stack of print media.

6. A method for providing a sheet feed apparatus, comprising the steps of:

providing a sheet support surface for supporting a stack of print media;

providing a sheet picking mechanism for retrieving individual sheets from said stack of print media;

positioning a sheet separation surface positioned along a sheet feed path downstream from said media tray;

mounting a plurality of pivoting arms in said imaging apparatus, said plurality of pivoting arms being moveable between a first position and a second position, said plurality of pivoting arms being positioned and individually spaced along a width of said sheet feed path, each of said pivoting arms having a media stack engaging surface, wherein when said plurality of pivoting arms is in said first position, said media stack engaging surface is substantially perpendicular to said sheet support surface of said media tray, and when said plurality of pivoting arms is in said second position, said media stack engaging surface is parallel to said sheet separation surface;

selectively moving said plurality of pivoting arms to said first position and to said second position, wherein the step of selectively moving said plurality of pivoting arms is effected by moving an automatic sheet feeder cover from a closed position toward an open position; and preventing a rotation of a sheet pick roller when said cover is not closed.

* * * * *